United States Patent [19]

Montgomery

[11] Patent Number: 4,466,617

[45] Date of Patent: Aug. 21, 1984

[54] SANDWICH SHAPED PISTON SEAL

[75] Inventor: James W. Montgomery, Huntsville, Tex.

[73] Assignee: Hughes Tool Company, Houston, Tex.

[21] Appl. No.: 500,213

[22] Filed: Jun. 2, 1983

[51] Int. Cl.[3] ..... F16J 15/12

[52] U.S. Cl. ..... 277/4; 277/30; 277/125; 277/182; 277/188 A; 277/234

[58] Field of Search ..... 277/4, 7, 12, 30, 32, 277/33, 66, 123-125, 128, 167.3, 182, 186, 188 R, 188 A, 193, 207 R, 234

[56] References Cited

U.S. PATENT DOCUMENTS

| | | | |
|---|---|---|---|
| 1,727,583 | 9/1929 | Cant | 277/4 X |
| 2,072,863 | 3/1937 | Balfe | 277/234 |
| 2,720,267 | 10/1955 | Brown | 277/123 X |
| 2,846,280 | 8/1958 | Berg | 277/234 X |
| 3,441,662 | 4/1969 | Augenstein et al. | 277/4 X |
| 4,219,204 | 8/1980 | Pippert | 277/152 X |
| 4,310,163 | 1/1982 | Pippert | 277/188 A |

FOREIGN PATENT DOCUMENTS

| | | | |
|---|---|---|---|
| 583348 | 12/1946 | United Kingdom | 277/182 |

*Primary Examiner*—Robert S. Ward

*Attorney, Agent, or Firm*—Robert A. Felsman; Charles D. Gunter, Jr.

[57] ABSTRACT

A sandwich shaped piston seal is shown for sealing multiple mandrel well packers. The seal has a plate shaped center portion made of a compliant elastomer material having upper and lower surfaces and an outer rim. The center portion is provided with multiple holes for receiving multiple mandrels with the mandrels being arranged perpendicular to the upper and lower surfaces. A pair of external backup rings circumscribe the outer rim of the elastomeric center portion and a pair of internal backup rings circumscribed the interior surface of each of the mandrel holes. A pair of header plates surround the center portion in sandwich fashion, the plates being provided with multiple holes corresponding to the holes in the center portion for receiving the mandrels. The backup ring design prevents extrusion of the elastomeric sealing portion when pressure acts upon the seal.

6 Claims, 6 Drawing Figures

FIG. 1
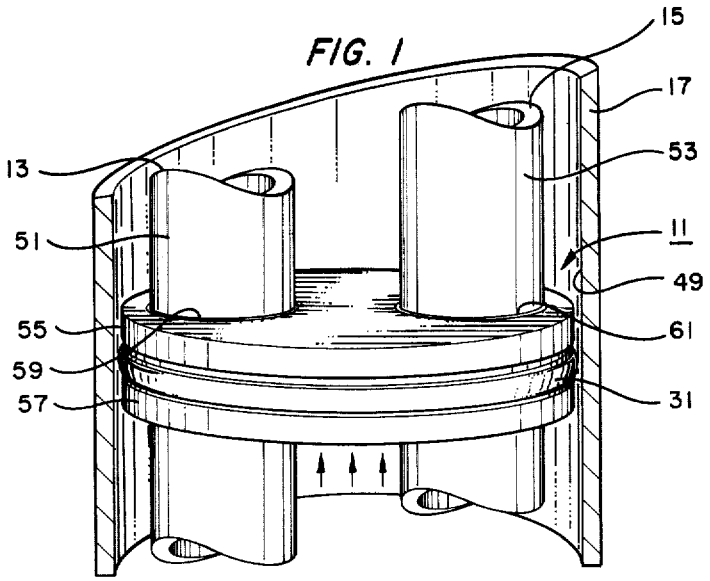
FIG. 2
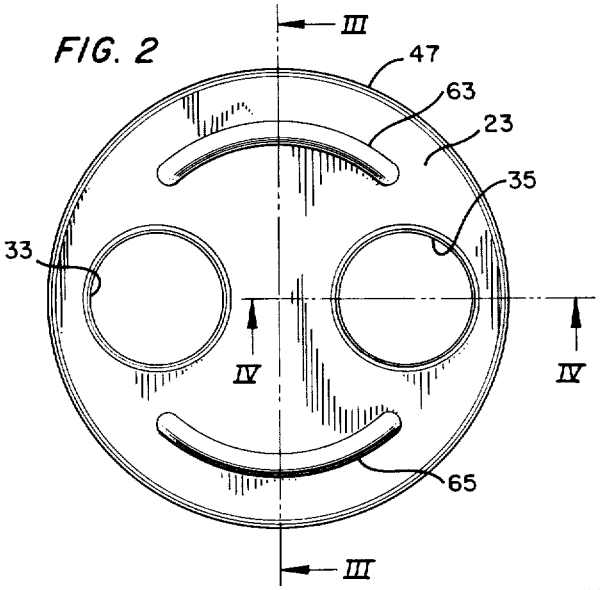
FIG. 3
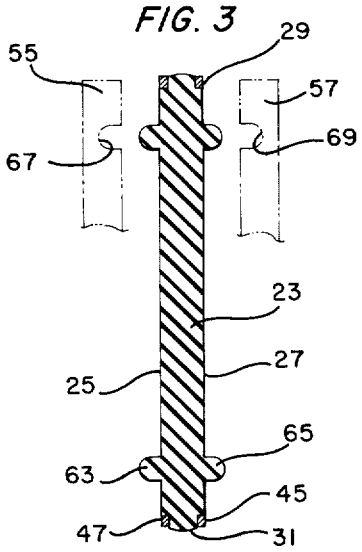
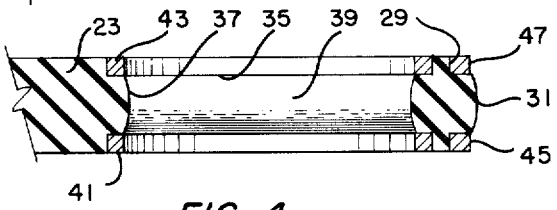
FIG. 4

SANDWICH SHAPED PISTON SEAL

CROSS-REFERENCE TO RELATED APPLICATIONS

The disclosure contained in this application is related to the disclosure contained in the application of Jay Jackson and Ruben Golden, entitled "Circular Seal With Integral Backup Rings", U.S. Ser. No. 500,212, filed concurrently herewith.

BACKGROUND OF THE INVENTION

The present invention relates generally to piston type seal configurations and specifically to a sandwich shaped piston seal for sealing multiple mandrels within the surrounding cylindrical body of a multiple mandrel well packer.

Multiple mandrel production packers used in the oil and gas well industry have a generally cylindrical outer body and two or more tubular members or mandrels which pass through the interior of the body parallel to the longitudinal axis of the body. By providing the ends of the mandrels of differing lengths, the multiple mandrel packer can be used to produce from multiple zones which are packed off within the well bore. In order to prevent crossover of well fluids and to insure the integrity of the packer seal, it is necessary to seal the multiple mandrels within the cylindrical body of the tool.

SUMMARY OF THE INVENTION

The seal configuration which comprises the present invention is a sandwich shaped piston seal for sealing multiple mandrels within the surrounding cylindrical body of a multiple mandrel well packer. The seal configuration has a plate shaped center portion made of a compliant elastomer material and has upper and lower surfaces and an outer rim. The elastomeric center portion of the seal is provided with multiple holes for receiving the multiple mandrels of the tool with the mandrels being generally perpendicular to the upper and lower surfaces. A pair of external backup rings circumscribe the outer rim of the center portion and a pair of internal backup rings circumscribe the interior surface of each of the mandrel holes. A pair of header plates surround the elastomeric center portion in sandwich fashion. The plates are provided with multiple holes corresponding to the holes in the center portion of the seal for receiving the mandrels.

Additional objects, features and advantages will be apparent in the written description which follows.

BRIEF DESCRIPTION OF THE DRAWINGS

FIG. 1 is a perspective view of the seal of the invention shown within the body of a well packer with parts of the packer broken away.

FIG. 2 is a top view of the center portion of the seal of the invention.

FIG. 3 is a cross-sectional view of the center portion of the seal taken along lines III—III in FIG. 2.

FIG. 4 is a cross-sectional view of the center portions of the seal taken along lines IV—IV in FIG. 2.

DETAILED DESCRIPTION OF THE INVENTION

Turning to FIG. 1, there is shown a sandwich shaped piston seal of the invention designated generally as 11. The piston seal 11 is used for sealing multiple mandrels, in this case, dual mandrels 13, 15 within the surrounding cylindrical body 17 of a multiple mandrel well packer.

Figure 5:
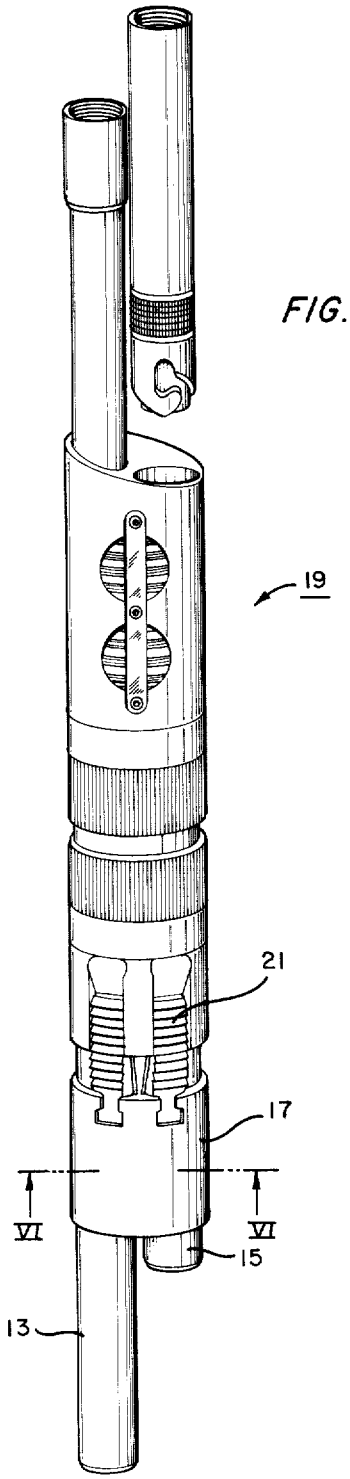
FIG. 5 is a perspective view of a dual mandrel production packer.
Figure 6:
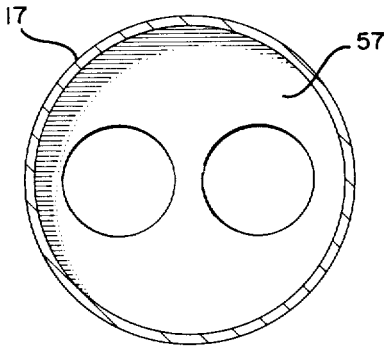
FIG. 6 is a cross-sectional view of the packer taken along lines VI—VI in FIG. 5 showing the location of the seal of the invention.

A dual mandrel packer 19 is shown in FIG. 5 and is a conventional design known to those in the oil and gas industry used to produce from multiple zones within a well bore. The dual mandrel packer 19 includes gripping elements 21 which are expanded radially outwardly within the well bore to grip the surrounding well casing (not shown) and hang the packer within the well bore. The present seal configuration is specifically designed to seal the mandrels 13, 15 within the surrounding cylindrical body 17 of the packer 19.

The seal of the invention, as shown in FIG. 3, has a plate shaped center portion 23 made of a compliant elastomer material having upper and lower surfaces 25, 27 and an outer rim 29. Any compliant elastomeric material can be utilized which is suitable for the well environment and which can be deformed by pressure to sealingly engage the adjacent metal surface. Suitable materials include hard and soft rubbers, including nitrile rubbers, specially modified rubbers such as Viton, and the like. The particular elastomer chosen will depend upon the well environment in which the tool is designed to operate. The elastomeric center portion 23 has a raised external rib 31 circumscribing the outer rim 29 thereof.

As shown in FIGS. 2 and 4, the elastomeric center portion 23 is provided with multiple holes 33, 35 for receiving the multiple mandrels 13, 15 with the mandrels being generally perpendicular to the upper and lower surfaces 25, 27. Each of the holes 33, 35 is provided with raised internal ribs 37 circumscribing the interior surface 39 of each of the holes in the mid region thereof.

A pair of internal backup rings 41, 43 circumscribes the interior surface 39 of each of the mandrel holes 33, 35 with one of the rings 41, 43 being received on either side of the raised internal rib 37. A corresponding pair of backup rings similarly circumscribes the outer rim 29 of the center portion 23. The external backup rings 45, 47 are received on either side of the raised external rib 31 of the elastomeric center portion 23. The internal and external backup rings are made from a relatively stiff material, preferably metal. Suitable materials include, for example, steel, brass and glass filled plastic.

The raised external and raised internal ribs 31, 37 are selectively sized to contact the interior surface 49 (FIG. 1) of the surrounding cylindrical packer body 17 and the exterior surfaces 51, 53 of the packer mandrels 13, 15, respectively, to provide an interference fit with these surfaces in the relaxed state. The backup rings 41, 43 and 45, 47 are undersized for the internal diameter of the cylindrical body 17 and exterior surface of the mandrels 51, 53, respectively, but are expandable when pressure acts on the seal 11 to provide a zero clearance fit with the packer body 17 and mandrels 13, 15. The backup rings must be made of a suitable material which can be strained radially to contact and form a seal with the adjacent metal surfaces without yielding. Suitable materials include, for example, steel, brass and glass filled plastics.

A pair of header plates 55, 57 (FIG. 1) surround the elastomeric center portion 23 in sandwich fashion. The header plates are preferably made of metal and are provided with multiple holes 59, 61 which correspond to the holes 33, 35 in the center portion 23 for receiving the mandrels 13, 15. In addition to being formed integrally with the center portion 23, either or both of the header plates 55, 57 can comprise a part of the packer 19 cylindrical body 17.

As shown in FIG. 3, the elastomeric center portion 23 can have raised lips 63, 65 formed in the upper and lower surfaces 25, 27 and which are received within corresponding grooves 67, 69 provided in the header plates 55, 57. Alternatively, the lips 63, 65 can be omitted and the center portion 23 can be bonded to the header plates 55, 57.

The operation of the present seal is illustrated with reference to FIGS. 1 and 4. As pressure acts upon the seal 11 in the direction of the arrows in FIG. 1, the external rib 31 of the elastomeric center portion 23 is deformed radially outwardly to form a tighter sealing engagement with the interior surface 49 of the cylindrical body 17. Similarly, the raised internal ribs 37 of the mandrel holes 33, 35 are expanded radially to form a tighter sealing engagement with the mandrels 13, 15. The metal backup rings 41, 43 and 45, 47 expand independently after the ribs 31, 37 to contact the respective metal sealing surfaces 49 and 51, 53 to provide a zero clearance fit with respect to the metal headers 55, 57, the interior surface 49 and the exterior surfaces 51, 53 of the mandrels 13, 15 depending upon the direction of the pressure acting upon the seal 11. The backup rings 41, 43 and 45, 47 prevent the elastomeric center portion 23 from being extruded into any clearance which exists between the metal parts as pressure acts upon the seal 11.

The invention has been provided with significant advantages. The sandwich shaped piston seal of the invention is relatively simple in design and easy to manufacture. Seal configurations of the present design can withstand well pressures in the range of 2,000–7,500 psi and greater at temperatures of 300°–400° F. or more. The backup rings which circumscribe the elastomeric center portion prevent extrusion of the elastomer and seal failure.

While the invention has been shown in only one of its forms, it is not thus limited but is susceptible to various changes and modifications without departing from the spirit thereof.

I claim:

1. A sandwich-shaped piston seal for sealing multiple mandrels within the surrounding cylindrical body of a multiple mandrel well packer, comprising:

a plate shaped center portion made of a compliant elastomer material having upper and lower surfaces and an outer rim, said center portion being provided with multiple holes for receiving said multiple mandrels with said mandrels being generally perpendicular to said upper and lower surfaces;

a pair of external backup rings circumscribing the outer rim of said center portion;

a pair of internal backup rings circumscribing the interior surface of each of said mandrel holes; and a pair of header plates surrounding said center portion in sandwich fashion, said plates being provided with multiple holes corresponding to said holes in said center portion for receiving said mandrels.

2. The seal of claim 1, wherein said elastomeric center portion has a raised external rib circumscribing the outer rim thereof and corresponding raised internal rib circumscribing the interior surface of each of said mandrel holes.

3. The seal of claim 2, wherein said pair of external backup rings are received on either side of said raised external rib and said internal backup rings are similarly received on either side of said raised internal ribs within said mandrel holes.

4. The seal of claim 3, wherein said backup rings are made from a relatively stiff material selected from the group consisting of steel, brass, and glass filled plastic.

5. The seal of claim 4, wherein said raised external and raised internal ribs of said elastomeric center portion are selectively sized to contact the interior surface of said surrounding cylindrical packer body and the exterior surfaces of said packer mandrels when pressure acts on said seal and wherein said backup rings are undersized for the internal diameter of said cylindrical body and the exterior surface of said mandrels, respectively, but are independently expandable when pressure acts on said seal to provide a zero clearance fit with said surrounding cylindrical packer body and said packer mandrels.

6. The seal of claim 5, wherein a selected one of said header plates comprises a wall portion of the surrounding cylindrical body of said well packer.

* * * * *